US012440042B2

(12) United States Patent
Yaklin

(10) Patent No.: US 12,440,042 B2
(45) Date of Patent: Oct. 14, 2025

(54) INFLATABLE SEAT CUSHION

(71) Applicant: Ease Seating Systems, Inc., Clio, MI (US)

(72) Inventor: Jeremy Yaklin, Columbiaville, MI (US)

(73) Assignee: Ease Seating Systems, Inc., Clio, MI (US)

( * ) Notice: Subject to any disclaimer, the term of this patent is extended or adjusted under 35 U.S.C. 154(b) by 0 days.

(21) Appl. No.: 18/744,572

(22) Filed: Jun. 14, 2024

(65) Prior Publication Data

US 2024/0335049 A1 Oct. 10, 2024

Related U.S. Application Data

(63) Continuation of application No. 17/521,744, filed on Nov. 8, 2021, now Pat. No. 12,042,053.

(60) Provisional application No. 63/110,808, filed on Nov. 6, 2020.

(51) Int. Cl.
*A47C 27/08* (2006.01)

(52) U.S. Cl.
CPC ..... *A47C 27/083* (2013.01); *A47C 27/082* (2013.01)

(58) Field of Classification Search
CPC ..... A47C 27/082; A47C 7/142; A47C 4/54; A47C 27/083; A47C 7/021; A47C 27/18
See application file for complete search history.

(56) References Cited

U.S. PATENT DOCUMENTS 3,867,732 A * 2/1975 Morrell ..... A47C 27/082 297/284.3
11,375,824 B2 * 7/2022 Bussert ..... F16K 11/085

* cited by examiner

*Primary Examiner* — Milton Nelson, Jr.
(74) *Attorney, Agent, or Firm* — The Watson IP Group; Jovan N. Jovanovic

(57) ABSTRACT

An inflatable seat cushion comprising a cushion assembly and a control assembly. The cushion assembly has a base and a bladder. The base has a top surface and a bottom surface and a controller cavity. The bladder has a chamber and is positionable on the top surface of the base. The chamber has an inlet. The control assembly is within the controller cavity and has a housing, a pump and a first valve assembly. The pump is positioned within the housing and has an outlet. The first valve assembly has an actuator, an inlet, a vent outlet and a bladder outlet. The inlet coupled to the outlet of the pump. The actuator can place the inlet into communication with the bladder outlet and the vent outlet into communication with the bladder outlet. The bladder outlet of the first valve assembly is in communication with the inlet of the bladder.

13 Claims, 8 Drawing Sheets

INFLATABLE SEAT CUSHION

CROSS-REFERENCE TO RELATED APPLICATION

This present application is a continuation of U.S. patent application Ser. No. 17/521,744 filed on Nov. 8, 2021, entitled "INFLATABLE SEAT CUSHION", which claims priority from U.S. Provisional Patent Application Ser. No. 63/110,808 filed on Nov. 6, 2020, entitled "INFLATABLE SEATING ASSEMBLY", the entire disclosure of which is hereby incorporated by reference in its entirety.

BACKGROUND OF THE DISCLOSURE

1. Field of the Disclosure

The disclosure relates in general to seating surfaces, and more particularly, to a plurality of different inflatable seating assemblies that are utilized in association with, for example, wheelchairs and the like to provide those which have physical mobility challenges changes in pressure points and pressure areas. The seating surfaces can be utilized on wheelchairs, as well as other seating surfaces which may be stationary or which may be mobile, such as wheelchair racers, trikes, and the like. The disclosure is not limited to any particular use of the inflatable seat cushion.

2. Background Art

For those that are confined to wheelchairs and the like, it is known that extended seating often results in the same portion of the body experiencing pressure. This can lead to discomfort, bed sores and infection. By varying the position of the pressure points, such problems can be minimized if not outright avoided.

Many solutions have been developed to assist with the movement of pressure points between a seating surface and the body. While such solutions have been provided. drawbacks remain. Many of these solutions are cumbersome, and difficult to operate, install and remove. Other deficiencies remain.

SUMMARY OF THE DISCLOSURE

The disclosure is directed, in one aspect, to an inflatable seat cushion comprising a cushion assembly and a control assembly. The cushion assembly has a base and a bladder. The base has a top surface and a bottom surface and a controller cavity therewithin. The bladder has at least one chamber. The bladder is positionable on the top surface of the base. The at least one chamber has an inlet. The control assembly is positionable within the controller cavity. The control assembly includes a housing, a pump and a first valve assembly. The pump is positioned within the housing and has an outlet. The first valve assembly has an actuator, an inlet, a vent outlet and a bladder outlet. The inlet is coupled to the outlet of the pump. The actuator is structurally configured to place the inlet into fluid communication with the bladder outlet and the vent outlet into fluid communication with the bladder outlet. The bladder outlet of the first valve assembly is placed into fluid communication with the inlet of the bladder.

In some configurations, the top surface of the base includes a buttock region, a first thigh region, a second thigh region and a central front region between the first thigh region and the second thigh region. The controller cavity is positioned so as to correspond to the central front region.

In some configurations, the controller cavity is accessible from the top surface of the base and from the bottom surface of the base.

In some configurations, a portion of the top surface extends over the control assembly when positioned within the controller cavity.

In some configurations, the at least one chamber comprises at least two chambers, with each chamber having an inlet.

In some configurations, a first of the at least two chambers includes a manifold extending along a first side of the base with a plurality of transverse legs extending across the base to a second side of the base. A second of the at least two chambers includes a manifold extending along the second side of the base with a plurality of transverse legs extending across the base to the first side of the base.

In some configurations, the transverse legs of the first of the at least two chambers one of overlie and are positioned adjacent the transverse legs of the second of the at least two chambers.

In some configurations, the transverse legs of the first of the at least two chambers are attached to a first manifold. The transverse legs of the second of the at least two chambers are attached to a second manifold.

In some configurations, the bladder is formed from a top panel and a bottom panel having seals joining the top panel and bottom panel to form the at least two chambers.

In some configurations, a cover having a first enclosure that is configured to receive the cushion assembly and the control assembly is provided.

In some configurations, the cover includes a top surface that includes a foam cushion configured to overlie the bladder positioned therewith.

In some configurations, the cover includes a bottom surface having an opening providing ingress into the first enclosure.

In some configurations, the cover further includes a second enclosure attached to the first enclosure. The second enclosure has a cavity structurally configured to receive a power adapter interfaceable with the control assembly.

In some configurations, the at least one chamber comprises at least two chambers, with each chamber having an inlet. Further, the control assembly includes a second valve assembly having an actuator, an inlet, a vent outlet and a bladder outlet, the inlet coupled to the outlet of the pump, and with the actuator structurally configured to place the inlet into fluid communication with the bladder outlet of the second of the at least two chambers and the vent outlet into fluid communication with the bladder outlet of the second of the at least two chambers.

In some configurations, the inlet of the first valve assembly and the inlet of the second valve assembly are coupled together and to the outlet of the pump.

In another aspect of the disclosure, the disclosure is directed to a control assembly for an inflatable seat cushion comprising a housing, a pump, a first valve assembly and a second valve assembly. The pump is positioned within the housing, and the pump has an outlet. The first valve assembly has an actuator, an inlet, a vent outlet and a bladder outlet, the inlet coupled to the outlet of the pump. The actuator is structurally configured to place the inlet into fluid communication with a bladder outlet of a first chamber of a bladder and the vent outlet into fluid communication with the bladder outlet of a first chamber of a bladder. The second valve assembly has an actuator, an inlet, a vent outlet and a bladder outlet, the inlet coupled to the outlet of the pump. The actuator is structurally configured to place the inlet into fluid communication with the bladder outlet of a second chamber of a bladder and the vent outlet into fluid communication with the bladder outlet of the second chamber of a bladder.

In some configurations, the control assembly further includes a controller circuitry positioned within the housing, and coupled to each of the actuator of the first valve assembly, the actuator of the second valve assembly and to the pump, the controller circuitry selectively actuating each of the pump, the actuator of the first valve assembly and the actuator of the second valve assembly.

In another aspect of the disclosure, the disclosure is directed to a method of assembling an inflatable cushion assembly comprising the steps of: providing a base having a top surface and a controller cavity; providing a bladder having at least one chamber having an inlet; placing the bladder onto the top surface of the base; providing a control assembly having a first valve assembly with a bladder outlet; placing the control assembly into the controller cavity of the base; and coupling the bladder outlet with the inlet of the bladder.

In some configurations, the bladder has at least a first chamber and a second chamber, and the control assembly has a second valve assembly with a bladder outlet, the method further including the steps of: coupling the bladder outlet of the second valve assembly with the inlet of the second bladder.

In some configurations, the method further comprises the steps of: providing a cover having a first enclosure; and inserting the base, the bladder and the control assembly within the first enclosure of the cover.

BRIEF DESCRIPTION OF THE DRAWINGS

The disclosure will now be described with reference to the drawings wherein.

DETAILED DESCRIPTION OF THE DISCLOSURE

Figure 1:
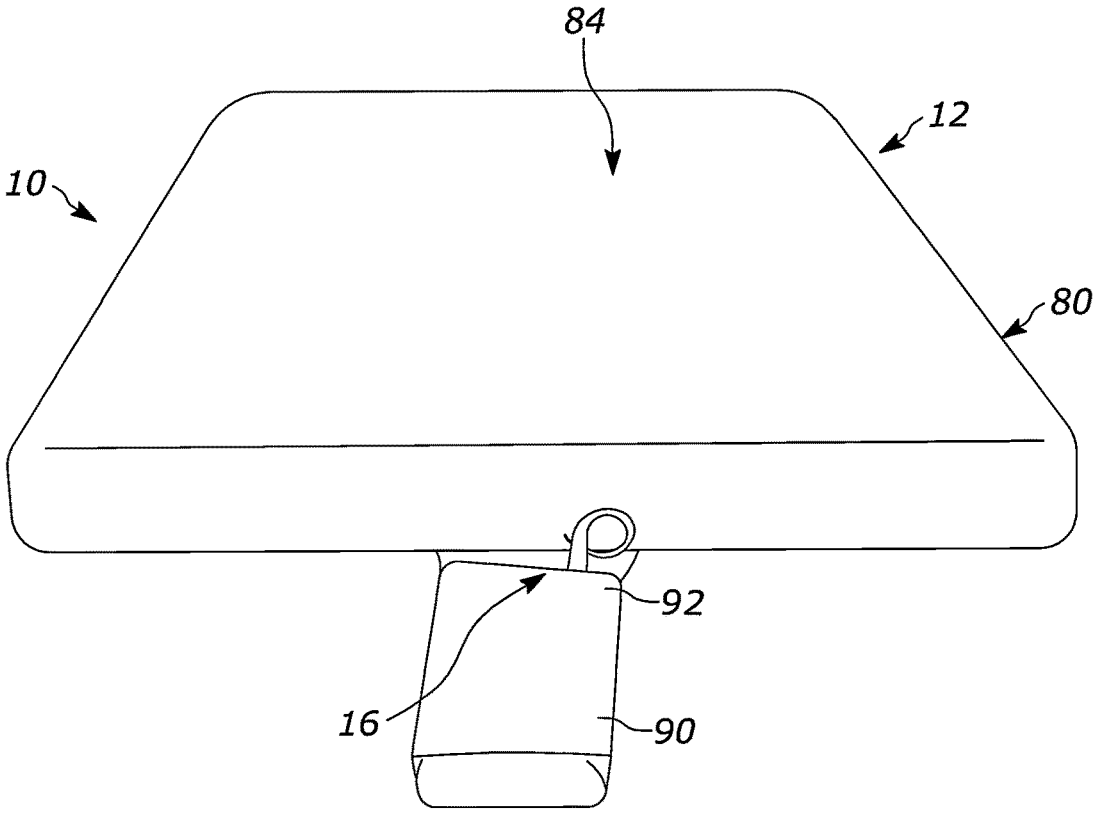
FIG. 1 of the drawings is a front perspective view of a configuration of the inflatable seat cushion of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings appended hereto, and in particular, FIG. 1, a configuration of the inflatable seat cushion is shown generally at 10. The inflatable seat cushion is configured for placement on a seating surface so as to provide enhanced comfort to a user. While not limited thereto, the cushion can be utilized for users that lack mobility and may be confined to a seating surface for extended periods of time. For example, the cushion may be utilized with wheel chairs, wheelchair racers, trikes, vehicle seats (car, truck, bus, aircraft, among others), bleachers, venue seats. Indeed, there is no practical limitation to the use of the cushion, while it's use in association with users of limited mobility are described herein for exemplary purposes only.

With reference to FIGS. 1 through 4, the inflatable seat cushion 10 includes cushion assembly 12, control assembly 14 and power adapter 16. The cushion assembly 12 includes base 20, bladder 50 and cover 80. Generally, the cushion assembly is sized so as to substantially correspond to an outside seating surface, of the type with which the cushion may be associated. Typically, the cushion may be configured to a four sided configuration (generally resembling a square or a rectangle), while other configurations are contemplated. In other configurations, the cushion may take a polygonal, circular, or oval general shape.

The base 20 includes bottom surface 22, top surface 24 opposite the bottom surface 22. A plurality of side surfaces, including front end 26, back end 28, first side 30 and second side 32 span between the top and bottom surfaces. In the configuration shown, the base comprises a molded foam member, such as a urethane foam. Other configurations are contemplated, including but not limited to fiber based structures, cut foam structures, among others. A controller cavity 48 may be defined in the base with an opening to either one or both of the top surface and the bottom surface or one of the spanning surfaces. In the configuration shown, the cavity opens to the bottom surface with a smaller opening to the upper surface, and the cavity is spaced apart from the sides and ends of the base.

The top surface 24 of the base includes a plurality of regions, including the buttock region 40, the first thigh region 42, the second thigh region 44 and central front region 46. The buttock region generally corresponds to the region of the top toward the back end 28 that is configured to receive the buttocks of the user. The first thigh region extends along the first side from the buttock region to the front end and is configured to receive the first thigh of the user. The second thigh region extends along the second side from the buttock region to the front end and is configured to receive the second thigh of the user. The central front region is generally the region between the first thigh region and the second thigh region. In the configuration shown, the controller cavity 48 is defined generally in the central front region. While an opening is provided to couple the bladder to the controller, generally a portion of padding remains between the cavity and the top surface over a larger portion of the cavity, so as to cushion the controller from the user with a portion of the base.

Figure 4:
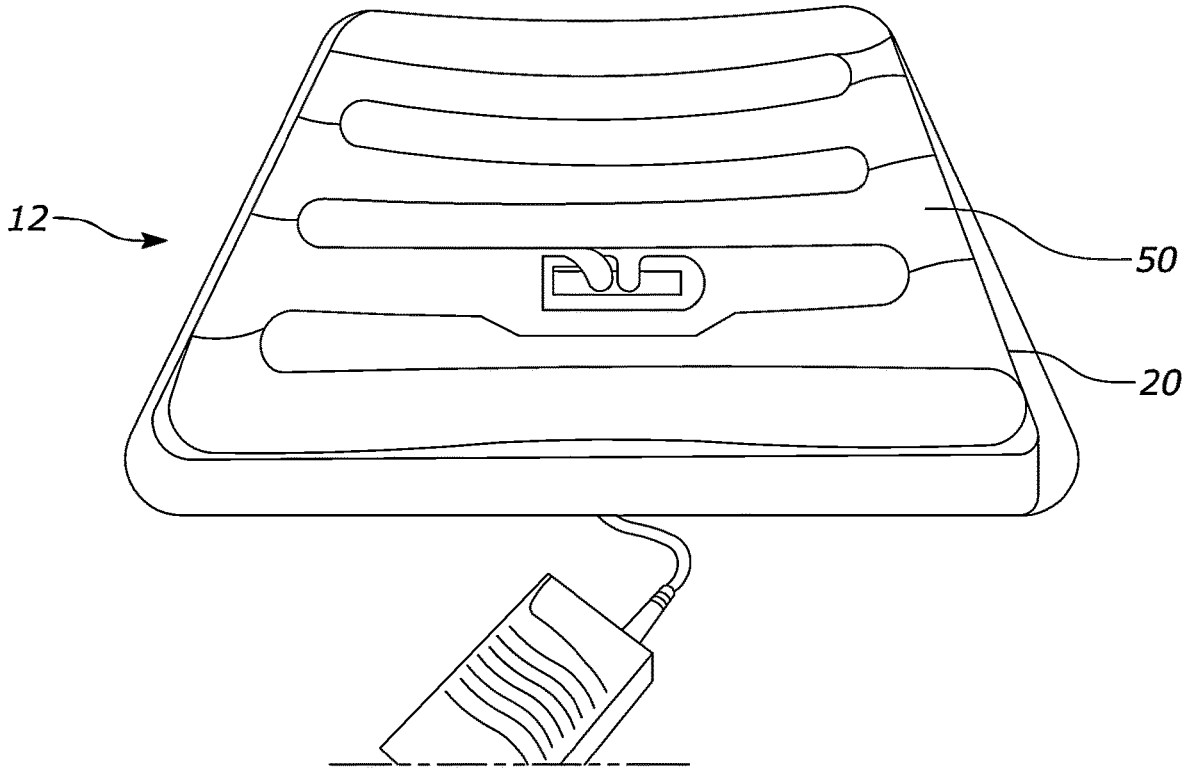
FIG. 4 of the drawings is a top perspective view of the base of the cushion assembly having the bladder positioned on the top surface thereof.
Figure 5:
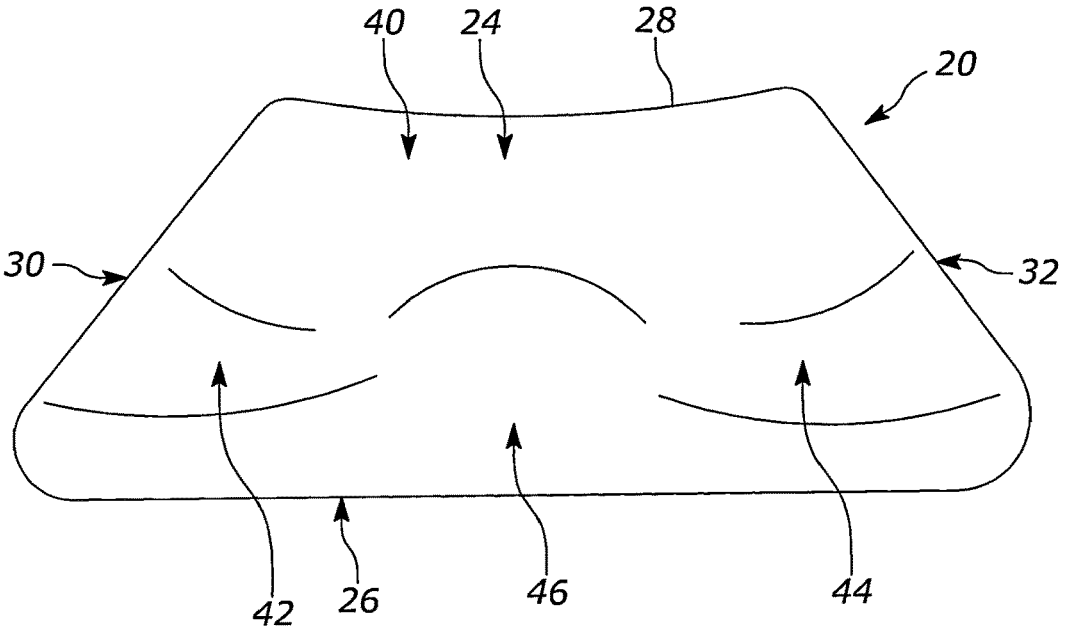
FIG. 5 of the drawings is a top perspective view of the base of the cushion assembly showing the different regions thereof.
Figure 7:
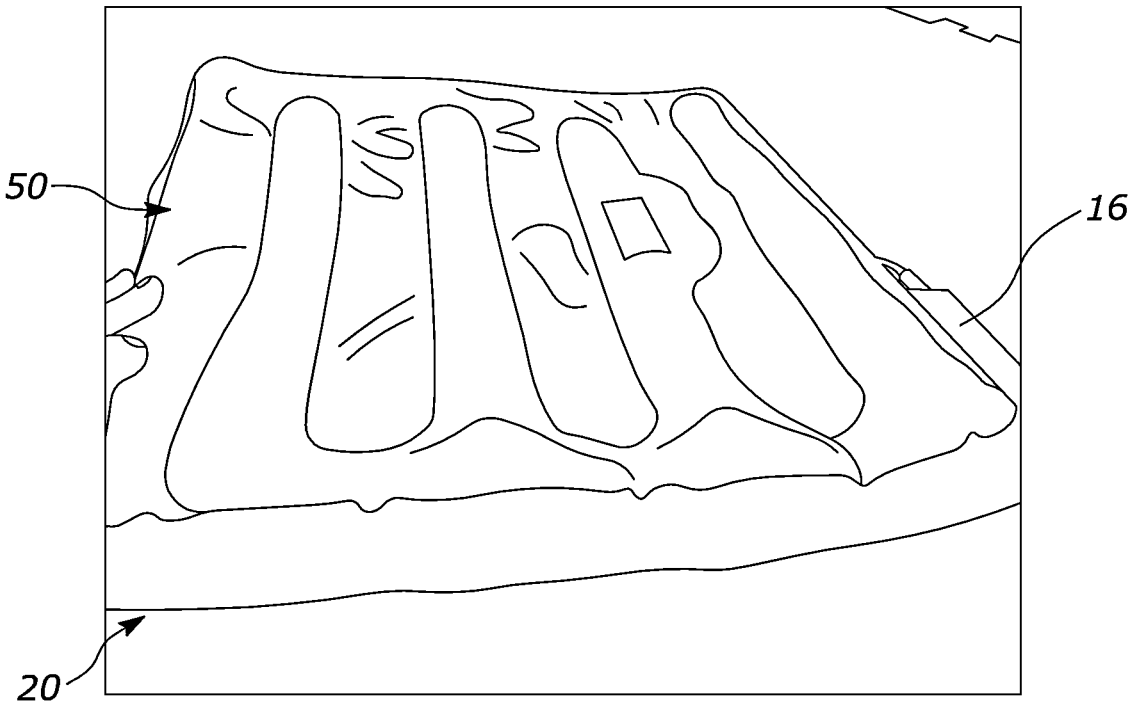
FIG. 7 of the drawings is a side perspective view of the base having the bladder positioned thereon and being coupled to the control assembly.
Figure 8:
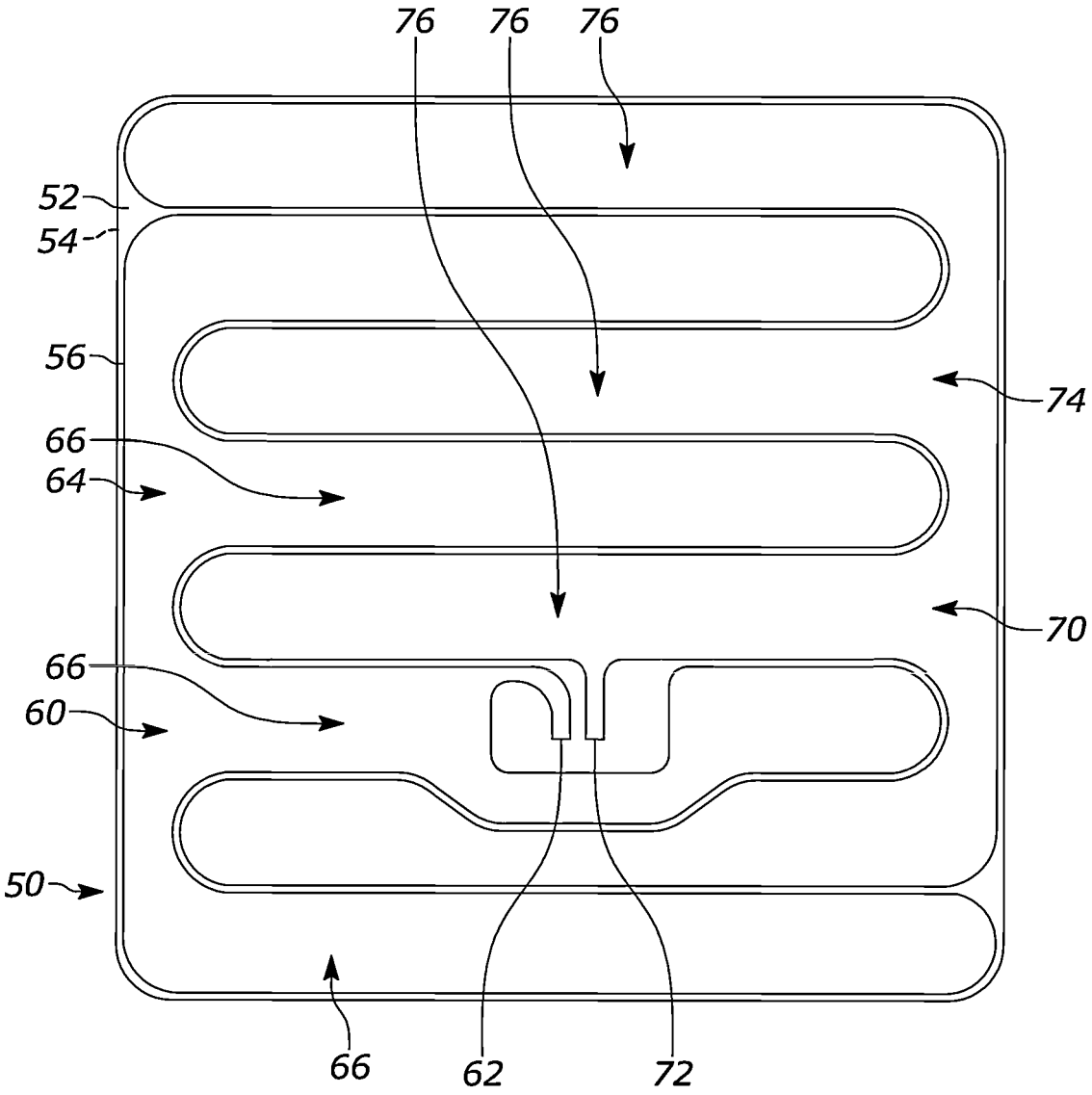
FIG. 8 of the drawings is a top plan view of a bladder of the present disclosure.

With reference to FIGS. 4, 7 and 8, the bladder 50 is shown as comprising top panel 52, bottom panel 54 and seals 56. In the configuration shown, the bladder forms two separate chambers through the use of the seals in cooperation with the top and bottom panels. In other configurations, instead of using a single top panel and a single bottom panel, it is contemplated that the chambers may be formed from completely separate top and bottom panels. For example, separate chambers can be formed which can be interlaced and overlapped in various configurations so as to provide continuous inflation portions. In any such configurations, it is further contemplated that more than two chambers can be utilized, such as three or more chambers in varying configurations.

In the configuration shown, each of the panels comprise a polymer material (i.e., a TPU) that is one of transparent and translucent, while other configurations are contemplated. The polymer is configured so as to be sealable to itself and may comprise a monolithic material, or a material having multiple layers that may be laminated or co-extruded, or a combination thereof.

In the configuration shown, the panels and seals combine to define two interrelated chambers, the first chamber 60 and the second chamber 70. The first chamber 60 includes an inlet 62, manifold 64 and a plurality of transverse legs, such as transverse leg 66. The inlet 62 is centrally located proximate the controller cavity 48 when installed on the top surface 24 of the base 20 along one of the transverse legs. The manifold 64 extends along the first side with the transverse legs 66 extend toward the second side from the manifold. In the configuration shown, a total of four transverse legs 66 extend from the manifold 64.

The second chamber 70 is similar in configuration to the first chamber and includes inlet 72, manifold 74 and a plurality of transverse legs, such as transverse legs 76. The inlet 72 is centrally located proximate the controller cavity 48 when installed on the top surface 24, and also proximate the inlet 62. In particular, the inlet is likewise along one of the transverse legs 76. The manifold 74 extends along the second side of the base 20 with the transverse legs 76 extending toward the first side. Additionally, the transverse legs are configured so as to be positioned in an alternating order from the front end to the back end of the top surface 24, in a nested or cooperative configuration. The transverse leg proximate the front end and the transverse leg proximate the second end extend to the first side and the second side, respectively, whereas the remaining transverse legs terminate at the opposing manifold.

It will be understood that a number of different configurations are contemplated for the bladder, and the chambers thereof. And, that the configuration shown is merely exemplary of the overall configurations, and not to be deemed limiting. It will also be understood that additional chambers can be incorporated into the bladder, that each of the chambers may be of significantly different configurations, perimeters and the like. For example, a greater number of transverse legs may be utilized, along with different shapes thereo (whereas in the configuration shown, the transverse legs comprises strips having a generally uniform width, for example).

The bladder may be adhered to the base 20 through a spray adhesive or a tape (such as a double sided tape, for example) such as a 3M-6035 adhesive transfer tape, or other means, such as heat sealing, RF welding among others.

Figure 2:
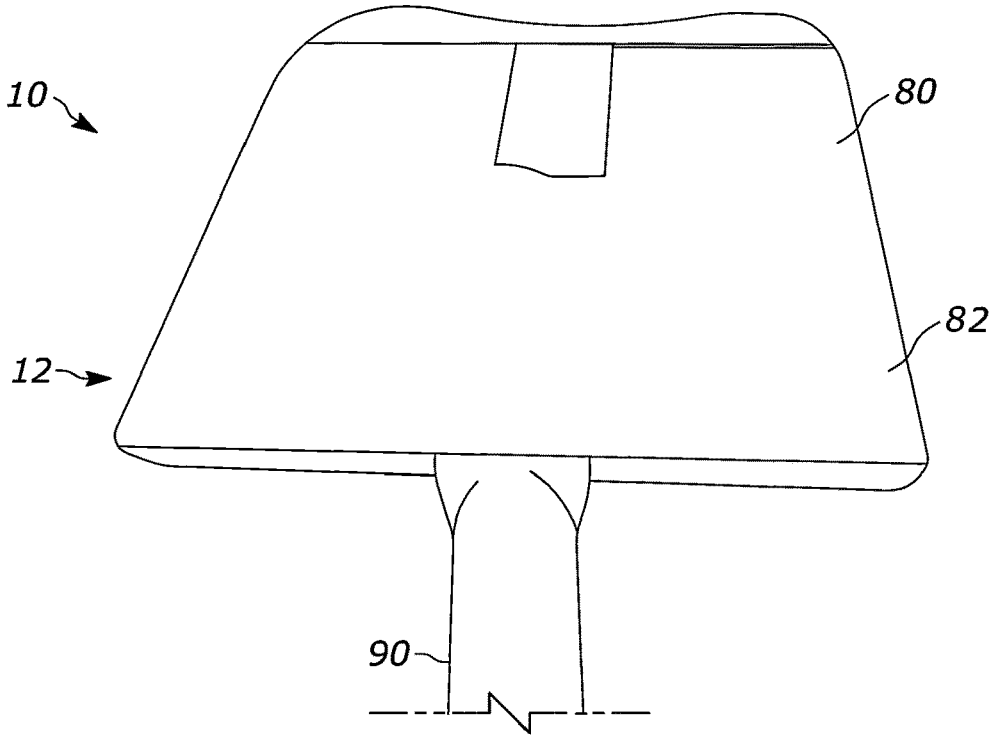
FIG. 2 of the drawings is a bottom perspective view of a configuration of the inflatable seat cushion of the present disclosure.
Figure 6:
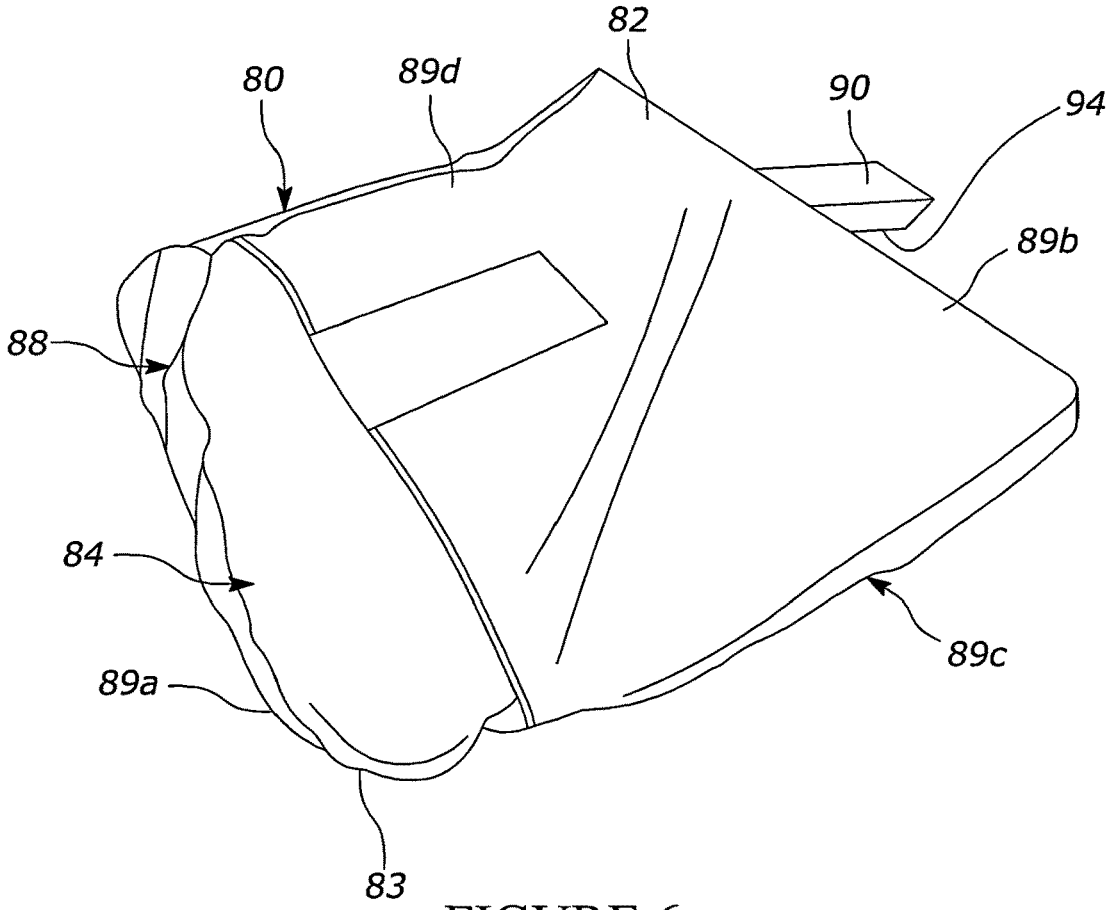
FIG. 6 of the drawings is a top perspective view of the cover of the cushion assembly showing the inner portion of the top surface having the foam positioned thereon.

With reference to FIGS. 1, 2 and 6, the cover 80 is configured to receive the cushion (along with the controller positioned within the controller cavity of the base) and to provide protection as to those components. The cover 80 is preferably removable so that the cover can be washed, cleaned, replaced or otherwise refreshed. At such time, it may be refitted onto the cushion.

The cover 80 includes first enclosure 82 (configured to receive the cushion) and second enclosure 90 (configured to receive the power adapter). The first enclosure generally shape matingly conforms to the base and bladder, and includes top surface 84, bottom surface 86 and, where desired, front and back ends as well as sides 89*a*-89*d*. A scrim foam may be incorporated into the top surface so as to provide additional cushioning to the top surface. Similarly other surfaces may likewise have a scrim foam applied thereto, or other cushioned material. In other configurations, additional foam may be placed onto the top panel of the bladder (i.e., adhered thereto, sealed thereto, among other coupling configurations).

An opening 88 may be disposed on the bottom surface which provides ingress into and egress from the cavity formed by the first enclosure. In the configuration shown, the opening extends from a first side to the second side spaced apart from the ends thereof. A closure member may be utilized, such as, for example, a zipper, snaps, hook and loop fasteners, among others. In other configurations, there may be an overlap of material at the opening so which material is manipulated to achieve access to the cavity.

It will be understood that in other configurations, the opening may be at an edge or side. In other configurations, the opening may be omitted, and the cover may be destroyed or cut to remove the base, bladder and controller therefrom. In still other configurations multiple covers may be utilized.

The first enclosure may be made from a woven or unwoven material, such as a fabric material which may include synthetic and/or natural fibers, or which may be formed from a film. The first enclosure may be of a material that is resistant to wear, water and/or stains. Additionally, it will be understood that multiple layers of material may be utilized to form the first enclosure (in addition to cushion layers) so as to maximize the different desired properties of the first enclosure.

The second enclosure 90 generally extends from the front end of the first enclosure and is generally centrally located proximate the central front region. The second enclosure is generally a sleeve 92 configured to receive the power adapter 16 therein. The second enclosure is generally of a flexible material and can move generally independently of the first enclosure.

Figure 3:
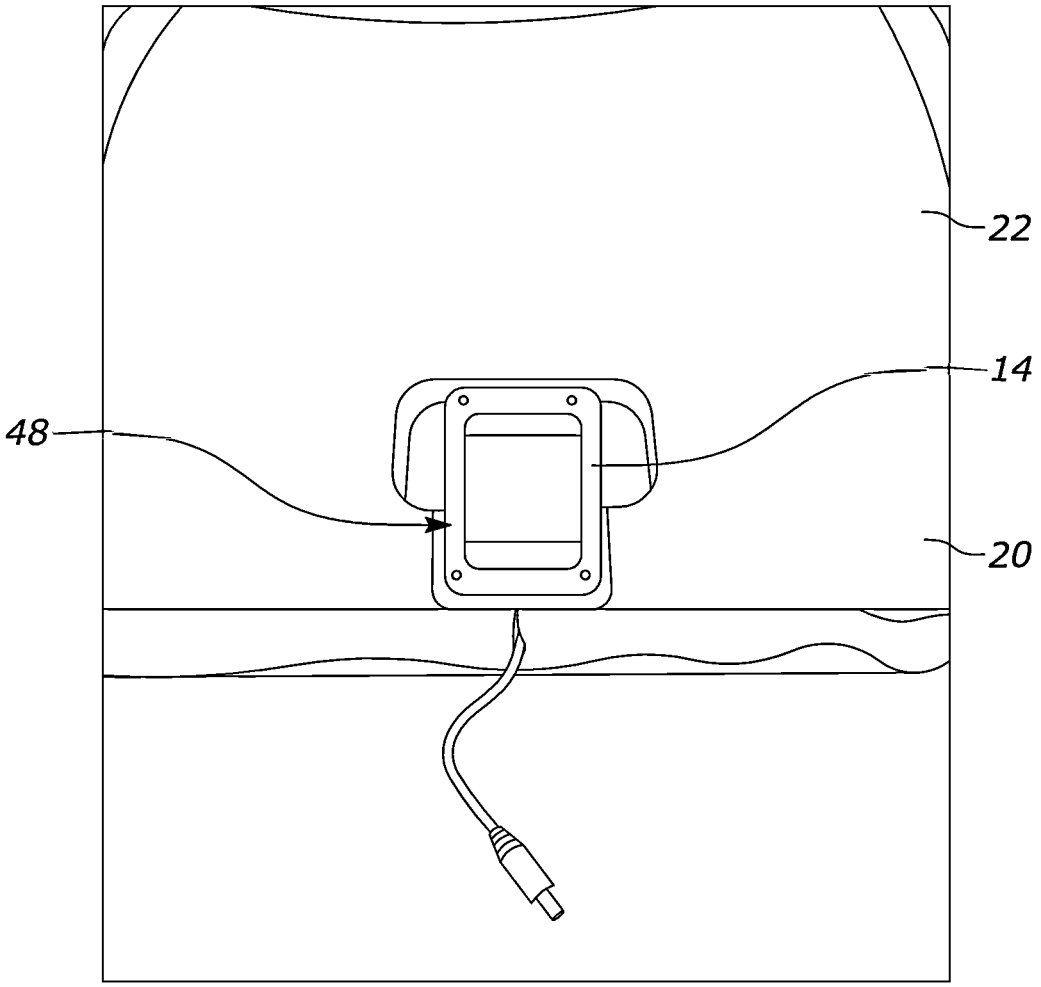
FIG. 3 of the drawings is a bottom perspective view of the base of the cushion assembly, showing, in particular, the control assembly positioned in the controller cavity.
Figure 9:
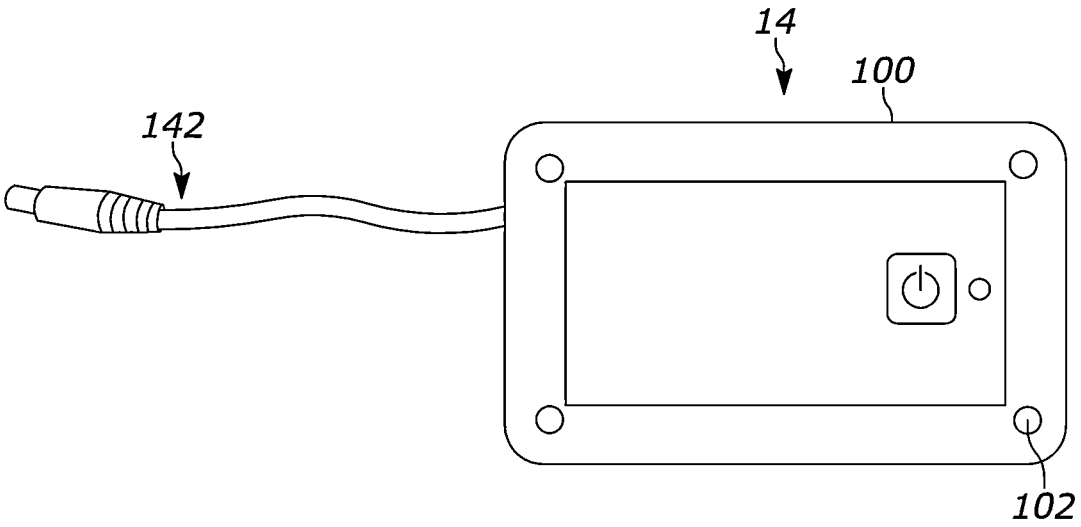
FIG. 9 of the drawings is a top plan view of a control assembly of the present disclosure, showing the housing and the power attachment.
Figure 10:
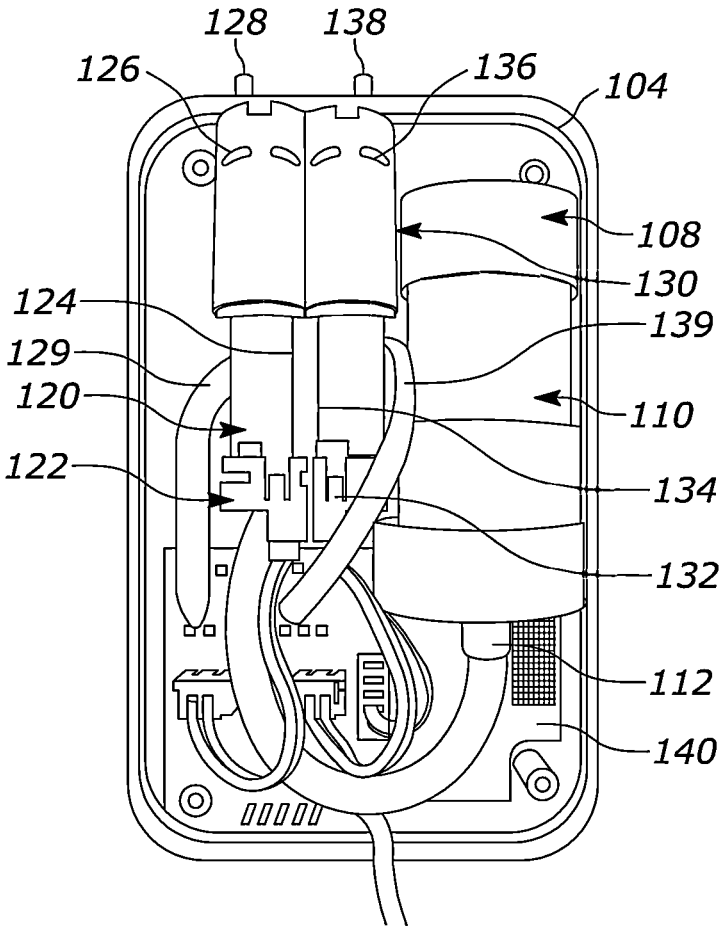
FIG. 10 of the drawings is a top plan view of the cavity of the control assembly showing the pump, the first and second valve assemblies and the controller circuitry therein.

The control assembly 14 is shown in FIGS. 3, 9 and 10 as comprising housing 100, pump 110, first valve assembly 120, second valve assembly 130 and controller circuitry 140. The controller circuitry may include, among other structures (disclosed below), a power attachment 142 which can be electrically coupled to power adapter 16.

The housing 100, in the configuration shown, includes an upper case portion and a lower case portion which defines a clamshell configuration with an internal cavity 106. The housing forms a generally a rectangular cubic configuration with relatively top surface 102 and bottom surface 104. Switches, buttons, and/or ports can be provided on the housing so that a user may be able to interface therewith.

Pump 110 may be positioned within the housing 100 and includes an outlet 112. The pump 110 may be sized so as to be able to fill a volume with air at a desired rate or within a desired time period. A number of different pump types are contemplated for use, and the disclosure is not limited to a particular type of pump.

The first valve assembly 120 and the second valve assembly 130 may be coupled together, or may comprise fully separable components. The first valve assembly 120 will be discussed with the understanding that the second valve assembly 130 is substantially similar in configuration and operation. It will be understood that, for example, the first and second valves may share a single input, while not required to do so or limited thereto.

The first valve assembly 120 includes actuator 122, inlet 124, vent outlet 126, bladder outlet 128 and sensor outlet 129. The valve may comprise a solenoid valve available from MAC Valves, Inc. of Wixom MI, such as for example, two position, three-way valves sold under the model BV-10 bullet valves (with a manifold therearound forming the vent outlet and the bladder outlet, as well as the inlet and the sensor outlet). The actuator 122 may comprise a solenoid that is selectively actuated by the control circuitry. The inlet 124 can be coupled to the outlet 112 of the pump 110. The vent outlet 126 is configured to vent air from the bladder outlet to ambient. The bladder outlet 128 is coupled to the inlet 62 of the first chamber 60 of the bladder. The sensor outlet 129 is in communication with the control circuitry to determine the pressure within the bladder.

It will be understood that the solenoid can selectively place the inlet into fluid communication with the bladder outlet, the bladder outlet with the vent outlet and the bladder outlet with the sensor outlet. Thus, in some configurations, the valve can be configured to provide air from the pump into the bladder until a desired pressure is reached. The valve can also be configured to allow the passage of air from the bladder to the vent outlet to reduce the air and/or pressure within the bladder. The sensor outlet provides a signal (i.e., to a pressure transducer on the control circuitry, for example) regarding the pressure within the bladder.

The second valve assembly 130 includes actuator 132, inlet 134, vent outlet 136, bladder outlet 138 and sensor outlet 139. The actuator 132 may comprise a solenoid that is selectively actuated by the control circuitry. The inlet 134 can be coupled to the outlet 112 of the pump 110 (wherein the inlet 124 and 134 can be joined prior to the coupling with outlet 112). The vent outlet 136 is configured to vent air from the bladder outlet to ambient. The bladder outlet 138 is coupled to the inlet 72 of the second chamber 70 of the bladder. The sensor outlet 139 is in communication with the control circuitry to determine the pressure within the bladder.

As with the first valve assembly, it will be understood that the solenoid can selectively place the inlet into fluid communication with the bladder outlet, the bladder outlet with the vent outlet and the bladder outlet with the sensor outlet. Thus, in some configurations, the valve can be configured to provide air from the pump into the bladder until a desired pressure is reached. The valve can also be configured to allow the passage of air from the bladder to the vent outlet to reduce the air and/or pressure within the bladder. The sensor outlet provides a signal (i.e., to a pressure transducer on the control circuitry, for example) regarding the pressure within the bladder.

The use of a single pump and a pair of the foregoing valve assemblies minimizes the size of the overall control assembly and allows for, among other things, the placement of the control assembly within the base while being unobtrusive to a user, due at least to the size thereof and/or the position thereof.

It will further be understood that the bladder outlets are interfaceable with the housing such that the inlets of the bladders can be attached to the bladder outlets of the control assembly.

The control circuitry may comprise a computing device, of varying complexity. It will be understood that although not required, aspects of the descriptions below will be provided in the general context of computer-executable instructions, such as program modules, being executed by a computing device. It will be understood that such acts and operations, which are at times referred to as being computer-executed, include the manipulation by a processing unit of electrical signals representing data in a structured form. This manipulation transforms the data or maintains it at locations in memory, which reconfigures or otherwise alters the operation of the computing device or peripherals in a manner well understood by those skilled in the art. The data structures where data is maintained are physical locations that have particular properties defined by the format of the data.

Generally, program modules include routines, programs, objects, components, data structures, and the like that perform particular tasks or implement particular abstract data types. Moreover, those skilled in the art will appreciate that the computing devices need not be limited to a specialized security system control module (which may be highly proprietary), a conventional server computing racks or conventional personal computers, and include other computing configurations, including hand-held devices having a few or many chips, a computing device such as a raspberry PI, multi-processor systems, microprocessor based or programmable consumer electronics, network PCs, minicomputers, mainframe computers, and the like. Similarly, the computing devices need not be limited to a stand-alone computing device, as the mechanisms may also be practiced in distributed computing environments linked through a communications network. In a distributed computing environment, program modules may be located in both local and remote memory storage devices.

Figure 11:
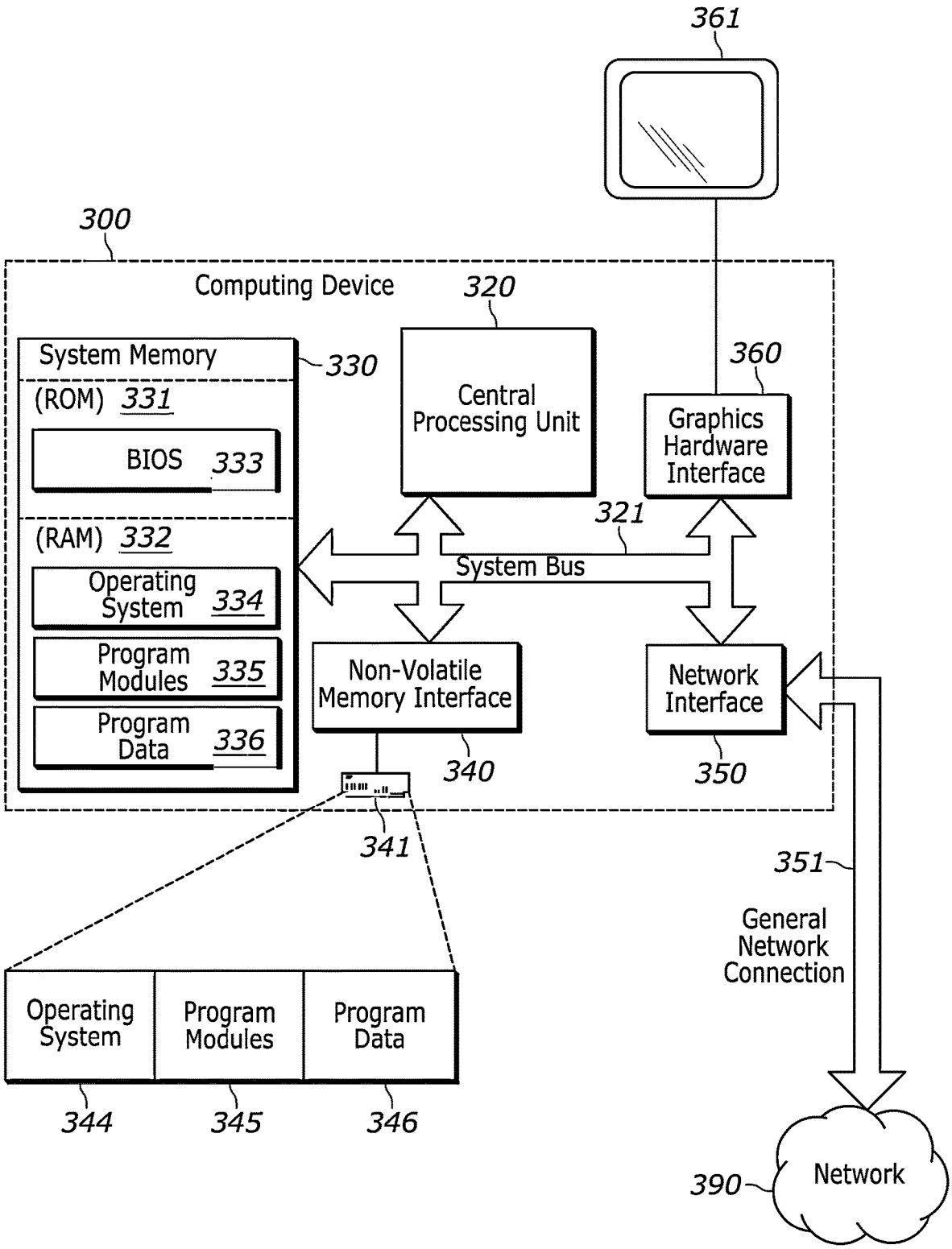
FIG. 11 of the drawing is a schematic of an exemplary computing device which may be utilized in association with the present disclosure.

With reference to FIG. 11, an exemplary general-purpose computing device is illustrated in the form of the exemplary general-purpose computing device 300. As such, it will be described with the understanding that variations can be made thereto. The exemplary general-purpose computing device 300 can include, but is not limited to, one or more central processing units (CPUs) 320, a system memory 330 and a system bus 321 that couples various system components including the system memory to the processing unit 320. The system bus 321 may be any of several types of bus structures including a memory bus or memory controller, a peripheral bus, and a local bus using any of a variety of bus architectures. Depending on the specific physical implementation, one or more of the CPUs 320, the system memory 330 and other components of the general-purpose computing device 300 can be physically co-located, such as on a single chip. In such a case, some or all of the system bus 321 can be nothing more than communicational pathways within a single chip structure and its illustration in FIG. 11 can be nothing more than notational convenience for the purpose of illustration.

The general-purpose computing device 300 also typically includes computer readable media, which can include any available media that can be accessed by computing device 300. By way of example, and not limitation, computer readable media may comprise computer storage media and communication media. Computer storage media includes media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by the general-purpose computing device 300. Computer storage media does not include communication media. Communication media typically embodies computer readable instructions, data structures, program modules or other data in a modulated data signal such as a carrier wave or other transport mechanism and includes any information delivery media. By way of example, and not limitation, communication media includes wired media such as a wired network or direct-wired connection, and wireless media such as acoustic, RF, infrared and other wireless media. Combinations of the any of the above should also be included within the scope of computer readable media.

When using communication media, the general-purpose computing device 300 may operate in a networked environment via logical connections to one or more remote computers. The computing device 300 is connected to the general network connection 371 through a network interface or adapter 370 that is, in turn, connected to the system bus 321. In a networked environment, program modules depicted relative to the general-purpose computing device 300, or portions or peripherals thereof, may be stored in the memory of one or more other computing devices that are communicatively coupled to the general-purpose computing device 300 through the general network connection 371. It will be appreciated that the network connections shown are exemplary and other means of establishing a communications link between computing devices may be used.

The general-purpose computing device 300 may also include other removable/non-removable, volatile/nonvolatile computer storage media. By way of example only, a hard disk drive 341 is illustrated that reads from or writes to non-removable, nonvolatile media. Other removable/non-removable, volatile/nonvolatile computer storage media that can be used with the exemplary computing device include, but are not limited to, magnetic tape cassettes, flash memory cards, digital versatile disks, digital video tape, solid state RAM, solid state ROM, and the like. The hard disk drive 341 is typically connected to the system bus 321 through a non-removable memory interface such as interface 340.

The drives and their associated computer storage media discussed above and illustrated in FIG. 3, provide storage of computer readable instructions, data structures, program modules and other data for the general-purpose computing device 300. It will be understood that for the controller circuitry, the system is preferably minimized with respect to the components required, and, the need for outside memory may be limited. It will be understood that it is contemplated that the controller circuitry may be programmed or augmented by communication with an outside computing device (such as, for example, a smartphone, or the like) through communication including, but not limited to wifi and/or Bluetooth.

The power adapter 16 is shown as comprising a battery pack having a wired coupling which can be attached to the power attachment. The power adapter 16 may likewise comprise a power brick that can be coupled to a wall outlet, or to an outlet of a car (i.e., 12 v cigarette outlet). In other configurations, it is contemplated that the power adapter may be coupled to the control assembly wirelessly (through an inductive connection, for example).

To assemble the inflatable seat cushion, first the base is provided. As set forth above, the base may comprise a molded urethane member, while other configurations and materials are contemplated. Once provided, the bladder can be provided. The bladder can be positioned so as to overlie the top surface of the base with the bottom panel being adhered to the top surface of the base with, for example, an adhesive transfer tape. Of course, other structures for coupling the bladder to the base are contemplated.

Once the bladder is coupled to the base, the control assembly can be provided. The control assembly (i.e., the housing 100 and the components therein) can be placed into the controller cavity 48 of the base 20. The housing is oriented so that outlets are positioned proximate the inlets to the bladders that are positioned proximate the controller cavity.

Once the control assembly is positioned within the controller cavity 48, the bladder outlet of the first valve assembly is coupled to the first chamber of the bladder. Similarly, the bladder outlet of the second valve assembly is coupled to the second chamber of the bladder.

Where the power attachment comprises a wire, the wire is extended out of the controller cavity, so as to be able to extend out of the cover and to be attachable to the power adapter.

The combination of the base, the bladder and the control assembly are inserted through the opening 88 of the first enclosure of the cover and fully into the first enclosure of the cover. Once fully inserted, the power attachment can be extended through a corresponding opening in the cover so as to be proximate the second enclosure. Where the opening includes a closure, the closure can be actuated so as to seal or close the remainder of the cushion assembly within the first enclosure along with the control assembly.

The power adapter 16 is coupled to the power attachment and the power adapter is inserted into the cavity of the second enclosure.

To operate the inflatable seat cushion, the inflatable seat cushion 10 is first placed on a seating surface, for example, a wheel chair. A user can then be seated on the top surface of the inflatable seat cushion. Next, the controller circuitry can be activated. Depending on the manner in which the controller circuitry is programmed, the first chamber of the bladder and the second chamber of the bladder can be inflated and deflated in a predetermined manner and to a particular desired pressure. For example, the controller circuitry can be programmed to sequentially fill and empty the first chamber followed by the second chamber to a desired pressure. In other words, the first chamber can be inflated to a desired pressure. Then after a desired time period, the first chamber can be deflated. The second chamber can then be inflated to a desired pressure. Then after a desired time period, the second chamber can be deflated. This process can be repeated over and over again.

As will be understood, the bladders can be inflated in any desired order, either individually or together. Additionally, the bladders can be inflated to any number of different pressures (which may be the same or different between the first and second chamber). The bladders can be maintained at any given pressure for any desired amount of time, and/or deflated at any desired time. It will be understood that the bladders can be programmed individually or in unison, such that they operate together, individually or randomly relative to each other. Indeed, there is no predetermined method or manner of inflation and/or deflation or desired pressure for either one of the first chamber or the second chamber. It will further be understood that at time, only one of the chambers may be utilized, whereas in other configurations both may be utilized (or a greater number of chambers, if there are more than two chambers) simultaneously, or sequentially, or both. Furthermore, in other configurations, a single chamber is contemplated.

It will be understood that wherein the power adapter comprises a rechargeable battery, multiple power adapters may be provided with the understanding that the user can remove and replace a power adapter that has been drained. In other configurations, the power adapter may comprise a power brick that is attached to an outside power supply, such as a vehicle (through a USB or a cigarette outlet, for example) or a wall plug.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A control assembly for an inflatable seat cushion, the control assembly comprising:

a housing;

a pump positioned within the housing, the pump having an outlet;

a first valve assembly having an actuator, an inlet, a vent outlet and a bladder outlet, the inlet coupled to the outlet of the pump, and with the actuator structurally configured to place the inlet into fluid communication with a bladder outlet of a first chamber of a bladder and the vent outlet into fluid communication with the bladder outlet of a first chamber of a bladder, a second valve assembly having an actuator, an inlet, a vent outlet and a bladder outlet, the inlet coupled to the outlet of the pump, and with the actuator structurally configured to place the inlet into fluid communication with the bladder outlet of a second chamber of a bladder and the vent outlet into fluid communication with the bladder outlet of the second chamber of a bladder; and controller circuitry positioned within the housing and coupled to each of the actuator of the first valve assembly, the actuator of the second valve assembly and to the pump, the controller circuitry selectively actuating each of the pump, the actuator of the first valve assembly and the actuator of the second valve assembly;

wherein each of the first valve assembly and the second valve assembly include a sensor outlet, with each sensor outlet coupled to a sensor structurally configured to provide data pertaining to the pressure within the respective one of the first valve assembly and the second valve assembly.

2. The control assembly of claim 1 wherein each of the first valve assembly and the second valve assembly is coupled to a respective one of the sensors with tubing.

3. The control assembly of claim 1 wherein the sensor for each of the first valve assembly and the second valve assembly is positioned within the housing.

4. The control assembly of claim 3 wherein the sensor for each of the first valve assembly and the second valve assembly comprises a pressure transducer.

5. The control assembly of claim 4 wherein the sensor for each of the first valve assembly and the second valve assembly is mounted to the control circuitry.

6. The control assembly of claim 1 wherein at least one of the first valve assembly and the second valve assembly comprises a two position, three-way valve.

7. A method of assembling an inflatable seat cushion, the method comprising:

providing a base having a top surface and a controller cavity;

providing a bladder having at least two separate chambers, each chamber having an outlet;

providing the control assembly, the control assembly comprising:

a housing, a pump positioned within the housing, the pump having an outlet, a first valve assembly having an actuator, an inlet, a vent outlet and a bladder outlet, the inlet coupled to the outlet of the pump and with the actuation structurally configured to place the inlet into fluid communication with a bladder outlet of a first chamber of a bladder and the vent outlet into fluid communication with the bladder outlet of a first chamber of a bladder, a second valve assembly having an actuator, an inlet, a vent outlet and a bladder outlet, the inlet coupled to the outlet of the pump, and with the actuator structurally configured to place the inlet into fluid communication with the bladder outlet of a second chamber of a bladder and the vent outlet into fluid communication with the bladder outlet of the second chamber of a bladder;

placing the bladder onto the top surface of the base;

placing the control assembly within the controller cavity of the base, the controller cavity having an opening to the top surface of the base;

coupling the outlet of the first chamber with the bladder outlet of the first valve assembly;

coupling the outlet of the second chamber with the bladder outlet of the second valve assembly;

enclosing the base, the bladder and the control assembly with a cover.

8. The method of assembling of claim 7 wherein the base has a bottom surface opposite the top surface with the bottom surface providing access to the controller cavity, wherein the step of placing the control assembly further comprises the step of:

placing the control assembly within the controller cavity of the base through the opening in the bottom surface of the base.

9. The method of assembling of claim 7 further comprising the step of attaching a power adapter to the control assembly.

10. The method of assembling of claim 9 wherein the power adapter further includes a battery.

11. The method of assembling of claim 7 wherein the step of coupling the outlet of the first chamber further comprises the step of directing the outlet of the first chamber toward the controller cavity and away from the top surface of the base.

12. The method of assembling of claim 7 wherein the step of coupling the outlet of the second chamber further comprises the step of directing the outlet of the second chamber toward the controller cavity and away from the top surface of the base.

13. The method of assembling of claim 7 wherein the step of enclosing further comprises the step of closing the cover by way of a zipper.

* * * * *